US009033438B2

(12) United States Patent
Kelly et al.

(10) Patent No.: US 9,033,438 B2
(45) Date of Patent: May 19, 2015

(54) SHELF ASSEMBLY FOR A REFRIGERATOR

(71) Applicant: Electrolux Home Products, Inc., Charlotte, NC (US)

(72) Inventors: Paul H. Kelly, Anderson, SC (US); Benjamin Mobley, Abbeville, SC (US); Akhil Karibandi, Anderson, SC (US); Caleb Gossens, Charlotte, NC (US); Peter Jenkinson, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 13/838,429

(22) Filed: Mar. 15, 2013

(65) Prior Publication Data

US 2014/0265803 A1 Sep. 18, 2014

(51) Int. Cl.

| | |
|---|---|
| ***A47B 96/04*** | (2006.01) |
| ***F25D 25/02*** | (2006.01) |
| ***F25D 23/00*** | (2006.01) |

(52) U.S. Cl.

CPC ..... *F25D 25/024* (2013.01); *F25D 23/00* (2013.01); *F25D 2325/021* (2013.01); *F25D 2325/022* (2013.01)

(58) Field of Classification Search

CPC ..... F25D 25/02; F25D 25/024; A47B 96/025

USPC ..... 312/404, 408, 410, 351; 108/63, 76, 86, 108/102, 106–108, 136

See application file for complete search history.

(56) References Cited

U.S. PATENT DOCUMENTS

| | | | | | |
|---|---|---|---|---|---|
| 1,925,371 | A | * | 9/1933 | Charter | 211/153 |
| 1,997,432 | A | * | 4/1935 | Replogle | 211/153 |
| 2,299,885 | A | * | 10/1942 | Ellsworth et al. | 108/92 |
| 2,317,232 | A | * | 4/1943 | Swedman | 312/271 |
| 2,319,470 | A | * | 5/1943 | Nobles | 211/153 |
| 2,352,345 | A | * | 6/1944 | Rundell | 211/153 |
| 2,565,845 | A | * | 8/1951 | Frederick | 312/246 |
| 3,334,954 | A | * | 8/1967 | Kesling | 312/304 |

(Continued)

FOREIGN PATENT DOCUMENTS

| | | | |
|---|---|---|---|
| EP | 0 157 461 | A2 | 10/1985 |
| WO | 2009/155679 | A2 | 12/2009 |
| WO | 2010/118492 | A2 | 10/2010 |

OTHER PUBLICATIONS

International Search Report issued in Application No. PCT/US2014/024161 dated Aug. 25, 2014.

(Continued)

*Primary Examiner* — Daniel J Troy
*Assistant Examiner* — Ryan A Doyle
(74) *Attorney, Agent, or Firm* — Pearne & Gordon LLP

(57) ABSTRACT

A shelf assembly is provided for a refrigerator with a food compartment that includes a rear wall and a pair of opposed side walls. The shelf assembly includes a first and second shelf portion with first and second support surfaces. The second shelf portion is slidably moveable relative to the first shelf portion between an extended position and a retracted position. In the extended position, the second shelf portion is arranged such that the second support surface is substantially coplanar with the first support surface and the second support surface is located generally between a first support surface and a side wall of the food compartment. In the retracted position, the second planar support surface is arranged subjacent to the first planar support surface.

17 Claims, 9 Drawing Sheets

(56) References Cited

U.S. PATENT DOCUMENTS

| | | | | |
|---|---|---|---|---|
| 3,859,932 | A | 1/1975 | Armstrong et al. | |
| 4,620,489 | A * | 11/1986 | Albano | 108/105 |
| 4,934,645 | A * | 6/1990 | Breslow | 248/242 |
| 6,349,717 | B1 * | 2/2002 | Thompson et al. | 126/337 R |
| 6,994,033 | B2 | 2/2006 | Kweon | |
| 7,258,317 | B1 | 8/2007 | Nagel | |
| 7,878,344 | B2 | 2/2011 | Martin et al. | |
| 2003/0020387 | A1 | 1/2003 | Wing et al. | |
| 2007/0176528 | A1 * | 8/2007 | Lee et al. | 312/408 |
| 2009/0250420 | A1 * | 10/2009 | Martin et al. | 211/134 |
| 2010/0109498 | A1 | 5/2010 | Ramm et al. | |
| 2010/0253197 | A1 * | 10/2010 | Jung | 312/408 |
| 2011/0001415 | A1 | 1/2011 | Park et al. | |
| 2012/0091084 | A1 * | 4/2012 | Amaral et al. | 211/80 |
| 2013/0020922 | A1 * | 1/2013 | Jang | 312/408 |

OTHER PUBLICATIONS

Written Opinion issued in Application No. PCT/US2014/024161 dated Aug. 25, 2014.

* cited by examiner

SHELF ASSEMBLY FOR A REFRIGERATOR

BACKGROUND OF THE INVENTION

1. Field of the Invention

This application relates generally to an adjustable shelf assembly for a refrigerator, and more specifically, to a shelf assembly that can expand and retract laterally.

2. Description of Related Art

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartment at temperatures below 0° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartment and fresh food compartment arranged in a side-by-side relationship. Whatever arrangement of the freezer compartment and the fresh food compartment is employed, typically, separate access doors are provided for the compartments so that either compartment may be accessed without exposing the other compartment to the ambient air.

Vertically spaced shelves are often provided within the compartments to provide support surfaces for food items to be stored within the compartments. As more shelves are provided within the compartments, the total area of support surfaces within the appliance is increased. However, the presence of a shelf vertically spaced above a lower shelf can often limit the vertical dimensions and quantity of food items that can be stored below on the lower shelf. Accordingly, there is a need in the art for a shelf assembly that can expand and retract so that when the shelf assembly is in the retracted position, the footprint of the shelf assembly above a lower shelf is reduced, which in turn, will allow for a greater flexibility of food items that can be stored on the lower shelf. Meanwhile, when greater support surface area within the compartment is desired, the shelf assembly can be adjusted to the extended position to provide additional support surface area.

SUMMARY

According to one aspect, the subject application involves a shelf assembly for a refrigerator comprising a food compartment and a door configured to provide access to the food compartment, the food compartment comprises a rear wall and a pair of opposed side walls extending normal from the rear wall. The shelf assembly comprises a first shelf portion comprising a first planar support surface that is arranged normal to the rear wall and the pair of opposed side walls. The shelf assembly further comprises a second shelf portion comprising a second planar support surface, the second shelf portion being slidably moveable relative to the first shelf portion between an extended position and a retracted position. At the extended position, the second shelf portion is arranged relative to the first shelf portion such that the second planar support surface is substantially coplanar with the first planar support surface and the second planar support surface is located generally between the first planar support surface and one of the side walls. At the retracted position, a majority of the second planar support surface is arranged subjacent to the first planar support surface.

According to another aspect, the subject application involves a shelf assembly for a refrigerator comprising a food compartment and a door configured to provide access to the food compartment, the food compartment comprises a rear wall and a pair of opposed side walls extending normal from the rear wall. The shelf assembly comprises a first shelf portion comprising a first planar support surface, the first planar support surface arranged normal to the rear wall and the pair of opposed side walls. The shelf assembly further comprises a second shelf portion comprising a second planar support surface and a rear bearing member, the second shelf portion being slidably moveable relative to the first shelf portion between an extended position and a retracted position. The shelf assembly still further comprises a rear channel arranged substantially parallel to the rear wall and configured to guide the rear bearing member as the second shelf portion is slidably moved between the extended and retracted positions. At the extended position, the second shelf portion is arranged relative to the first shelf portion such that the second planar support surface is substantially coplanar with the first planar support surface and the second planar support surface is located generally between the first planar support surface and one of the side walls. At the retracted position, a majority of the second planar support surface is arranged subjacent to the first planar support surface.

According to yet another aspect, the subject application involves a shelf assembly for a refrigerator comprising a food compartment and a door configured to provide access to the food compartment, the food compartment comprises a rear wall and a pair of opposed side walls extending normal from the rear wall. The shelf assembly comprises a first shelf portion comprising a first planar support surface, the first planar support surface arranged normal to the rear wall and the pair of opposed side walls. The shelf assembly further comprises a second shelf portion comprising a second planar support surface and a rear bearing member, the second shelf portion being slidably moveable relative to the first shelf portion between an extended position and a retracted position. The shelf assembly still further comprises a rear elongated slot arranged substantially parallel to the rear wall and configured to at least partially receive the rear bearing members therein to guide the rear bearing members as the second shelf portion is slidably moved between the extended and retracted positions. At the extended position, the second shelf portion is arranged relative to the first shelf portion such that the second planar support surface is substantially coplanar with the first planar support surface and the second planar support surface is located generally between the first planar support surface and one of the side walls. At the retracted position, a majority of the second planar support surface is arranged subjacent to the first planar support surface.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
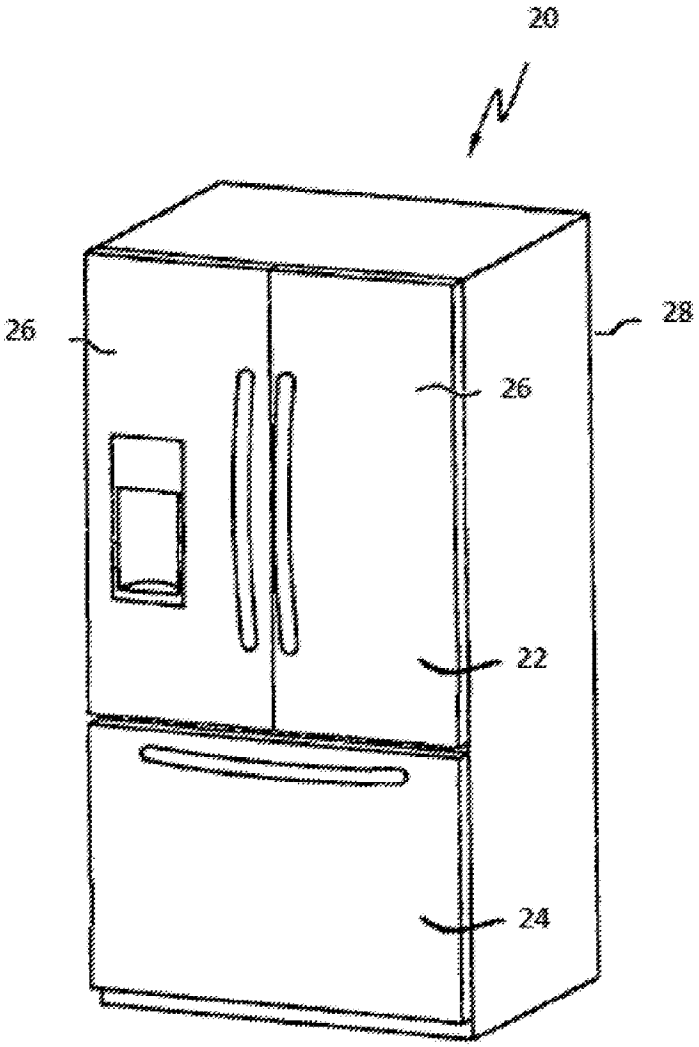
FIG. 1 shows a perspective view of an embodiment of a refrigerator including a fresh food compartment and freezer compartment.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

Referring to FIG. 1, there is illustrated a refrigeration appliance in the form of a domestic refrigerator, indicated generally at 20. Although the detailed description of an embodiment of the present invention that follows concerns a domestic refrigerator 20, the invention can be embodied by refrigeration appliances other than with a domestic refrigerator 20. Further, an embodiment is described in detail below, and shown in the figures as a bottom-mount configuration of a refrigerator 20, including a fresh-food compartment 22 disposed vertically above a freezer compartment 24. However, the refrigerator 20 can have any desired configuration which includes a fresh food compartment 22 without departing from the scope of the present invention.

One or more doors are pivotally coupled to a cabinet 28 of the refrigerator 20 to restrict and grant access to the fresh food compartment 22. The refrigerator 20 can include a single door that spans the entire lateral distance across the entrance to the fresh food compartment 22. Alternatively, the refrigerator 20 can include a pair of French-type doors 26, as shown in FIG. 1, that collectively span the entire lateral distance of the entrance to the fresh food compartment 22 to enclose the fresh food compartment 22. However, it should be appreciated that the one or more doors can be configured in any way which provides access to the food compartment 22.

Figure 2:
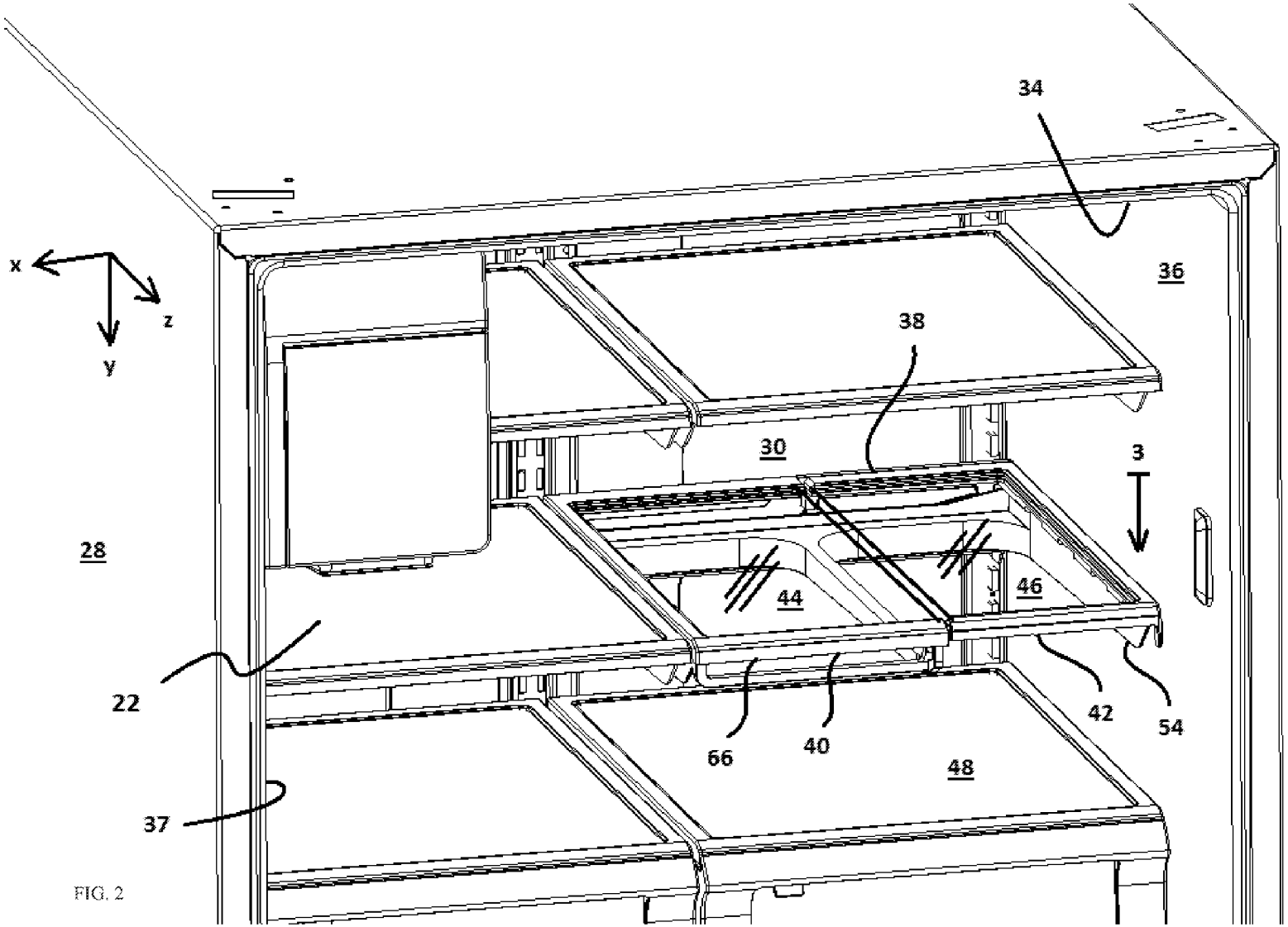
FIG. 2 shows a partial perspective view of an embodiment of a refrigerator including an example adjustable shelf assembly in a fresh food compartment, with the adjustable shelf assembly in an extended position.

FIG. 2 shows a front partial perspective view looking into the food compartment 22. The doors 26 are not shown in this figure to provide a better view of the food compartment 22. The food compartment 22 is defined by a rear wall 30, a bottom wall (not shown), a top wall 34, and a pair of opposed side walls 36, 37 extending normal from the rear wall 30 and bounded by the top wall 34 and bottom wall. An adjustable shelf assembly 38 is provided inside the food compartment 22 of the refrigerator 20, and includes a first shelf portion 40 and second shelf portion 42. The adjustable shelf assembly 38 as shown in FIG. 2 is in the extended position. The first and second shelf portions 40, 42 respectively include a first planar support surface 44 and a second planar support surface 46, both of which can be used as surfaces to store items on within the food compartment 22. The support surfaces 44, 46 are removable or non-removable rigid surfaces to support items within the refrigerator, and are preferably transparent or translucent (such as glass sheets) that are inserted into the shelf portions 40, 42, as shown in FIG. 2. Alternatively, the support surfaces 44, 46 can be integrally formed with the shelf portions 40, 42.

Figure 3:
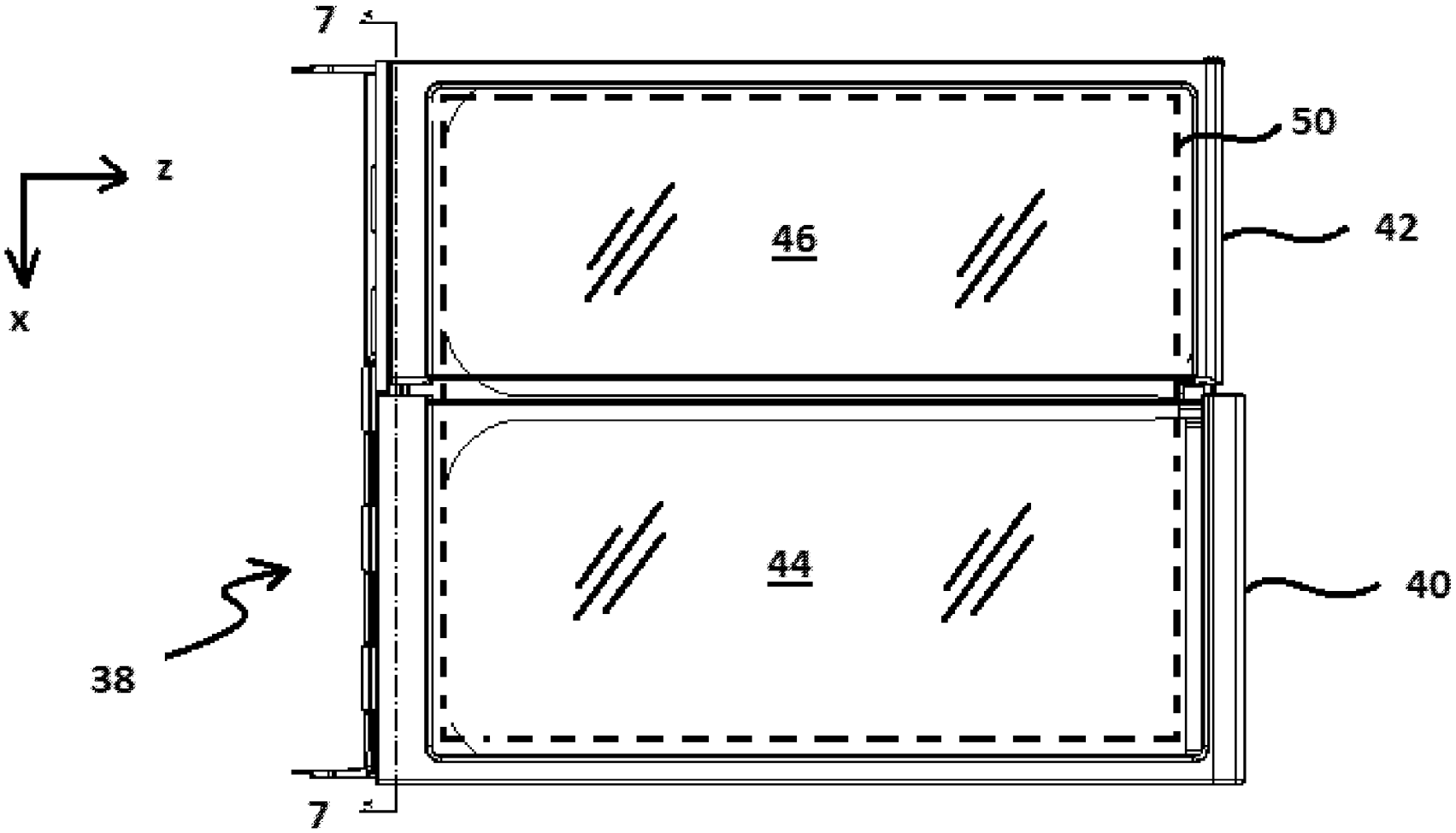
FIG. 3 shows a top view of the example adjustable shelf assembly from the direction of arrow 3 in FIG. 2.

In the extended position, the first shelf portion 40 is arranged such that the first planar support surface 44 is normal to the rear wall 30 and the pair of opposed side walls 36, 37. Additionally, the second planar support surface 46 is arranged relative to the first shelf portion 40 such that the second planar support surface 46 is substantially coplanar with the first planar support surface 44 and the second planar support surface 46 is located generally between the first planar support surface 44 and side wall 36. Thus, in the extended position, the two support surfaces 44, 46 can form a larger single support surface that spans across the depth of the support surfaces 44, 46 and their combined width, as represented by dashed line 50 in the top view of FIG. 3. Still, it is understood that the support surface 44, 46 may be separated by a relatively small gap. When the second shelf portion 42 is in the extended position, the second shelf portion 42 can present an obstruction relative to a lower shelf 48 that can limit the dimensions and quantity of food items that may rest on lower shelf 48, such as tall bottles or the like. To alleviate this problem, one of the shelf portions 40, 42 (such as the second shelf portion 42) of the shelf assembly 38 can be slidably moveable, relative to the other shelf portion (such as the first shelf portion 40), between an extended position and a retracted position.

Figure 4:
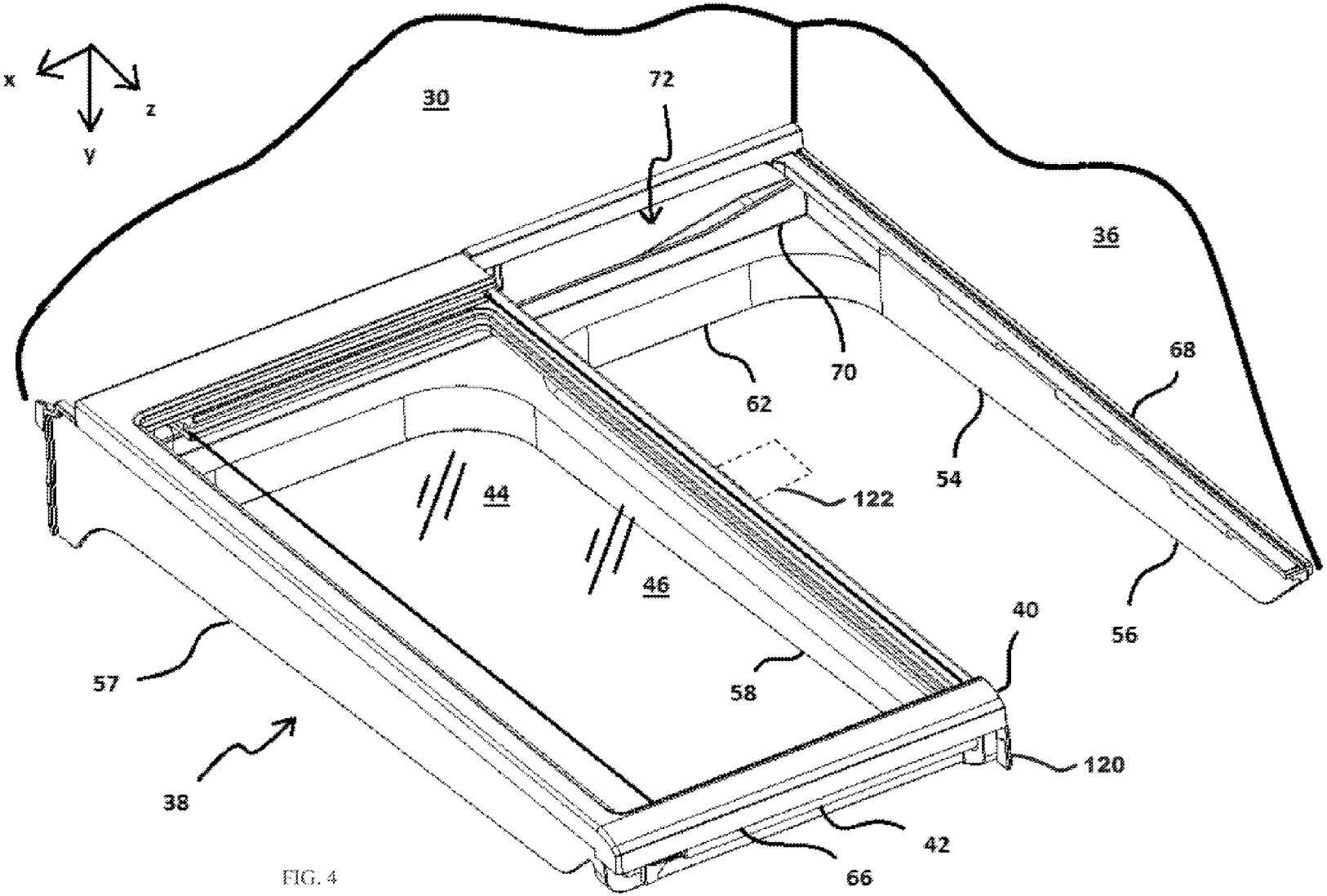
FIG. 4 shows a perspective view of the example shelf assembly in the retracted position.

FIG. 4 shows the second shelf portion 42 in the retracted position. When the second shelf portion 42 is in the retracted position, the second planar support surface 46 is arranged subjacent to the first planar support surface 44. Preferably, the second planar support surface 46 has a width and a depth that are, respectively, substantially equal to or less than the width and depth of the first planar support surface 44 so that a majority (such as all) of the second planar support surface 46 is arranged subjacent to the first planar support surface 44 in the retracted position. However, it is contemplated that there may be embodiments wherein the second planar support surface 46 is not entirely subjacent to the first planar support surface 44 in the retracted position, and even embodiments where less than a majority of the second planar support surface 46 is arranged subjacent to the first planar support surface 44.

The shelf assembly 38 can thus be used in conjunction with a series of vertically spaced shelves, where it is desirable at some times to be able to accommodate tall or bulky items with the least amount of preparation or manipulation by slidably moving the second shelf portion 42 into the retracted position underneath the first shelf portion 40, so that tall or bulky items can be stored beneath the shelf assembly 38 where the second shelf portion 42 would normally be located in the extended position. Meanwhile, when greater support surface area is desired within the fresh food compartment 22, the second shelf portion 42 can be slidably moved to the extended position to increase the total support surface area of the adjustable shelf assembly 38.

It is appreciated that the relative dimensions of the support surfaces 44, 46 as shown in FIGS. 1-4 need not be specific limitations upon the present application. For example, there may be embodiments where either support surface 44, 46 has a substantially different width and depth from the other support surface. Moreover, support surfaces 44, 46 may have widths and depths relative to the food compartment 22 that are greater/smaller than the widths and depths illustrated in FIG. 2. For example, each planar support surface 44, 46 may have a width that is approximately one-half the width of the food compartment 22 and a depth that is approximately equal to the depth of the food compartment 22. When such an embodiment is in the extended position, the support surfaces 44, 46 can form a single support surface that spans approximately across the entire width and/or depth of the food compartment 22.

It is further appreciated that although the embodiment illustrated in FIG. 2 shows a second shelf portion 42 that rests to the right of the first shelf portion 40 (viewing into the fresh food compartment 22) when in the extended position, other embodiments may have the positions of the first and second shelf portions 40, 42 reversed such that the second shelf portion 42 will rest to the left of the first shelf portion 40 in the extended position. As such, the second shelf portion 42 may slidably move from left to right between the extended and retracted positions rather than right to left, as shown in FIG. 2.

Figure 5:
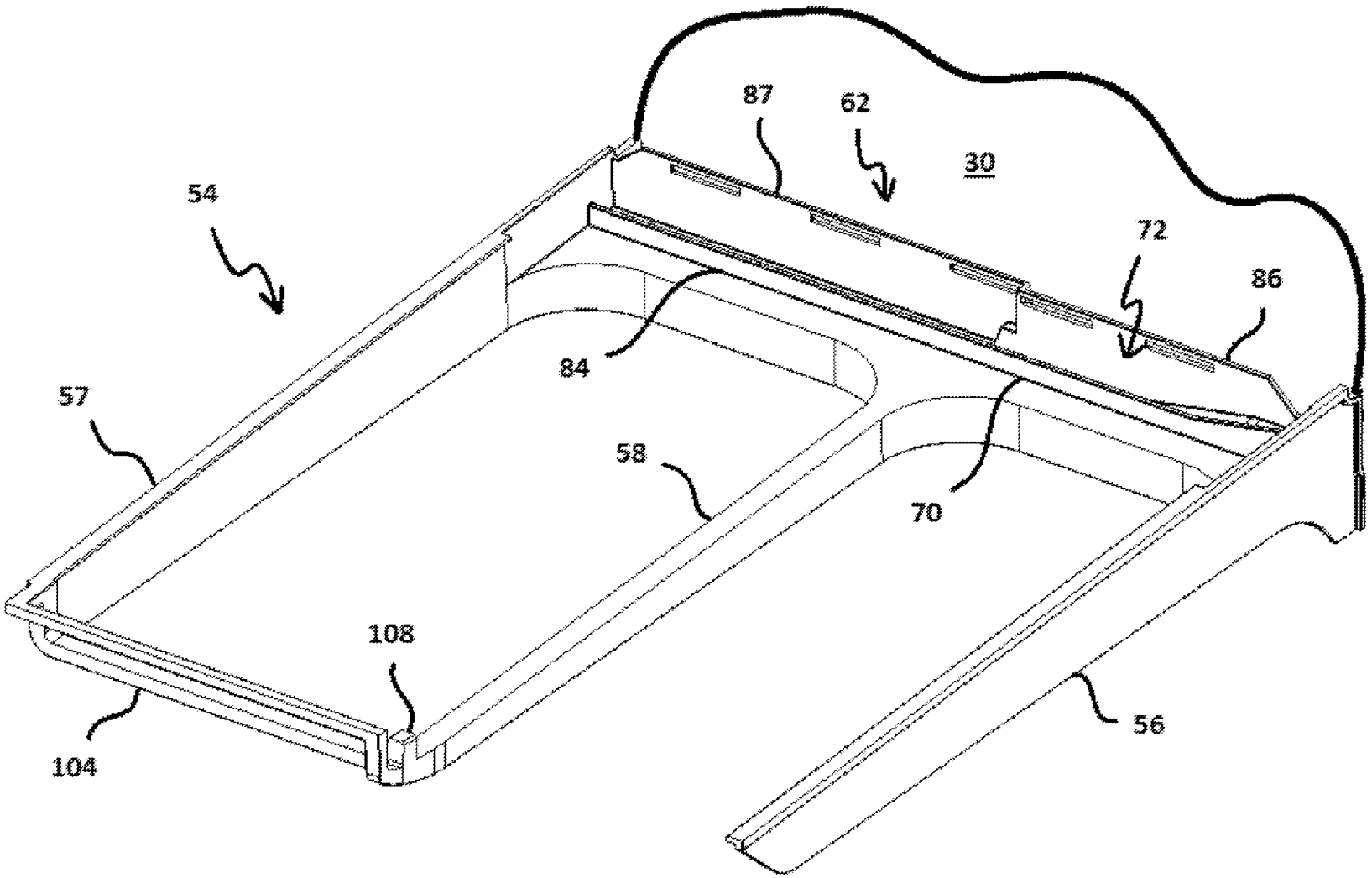
FIG. 5 shows a perspective view of an example frame for the example shelf assembly.

Turning now to FIG. 5, the shelf assembly 38 can include a frame 54. The frame 54 can be substantially rigid, such as metal or plastic. In one example, the frame 54 is made of die-cast aluminum alloy. The example frame 54 in FIG. 5 includes two opposed side arms 56, 57 and a middle support arm 58 that are arranged in parallel and extend from a back portion 62. The back portion 62 is arranged horizontal and substantially parallel to the rear wall 30 such that the side arms 56, 57 and middle support arm 58 project normally from the rear wall 30. The frame 54 can be integral with the food compartment 22, or the frame 54 can be a separate component. For example, a separate frame 54 can rest on ledges provided along the walls of the food compartment 22. Alternatively, the frame 54 can be mounted to the food compartment 22 using hooks (see FIG. 10) removably or non-removably mountable onto a ladder track or the like on the rear wall 30 and cantilever the frame 54 from the rear wall 30. The frame 54 can also be mounted using other fastening structure such as bolts, screws, adhesive, or the like, and may even include locking structure to inhibit inadvertent removal from the refrigerator.

Figure 6:
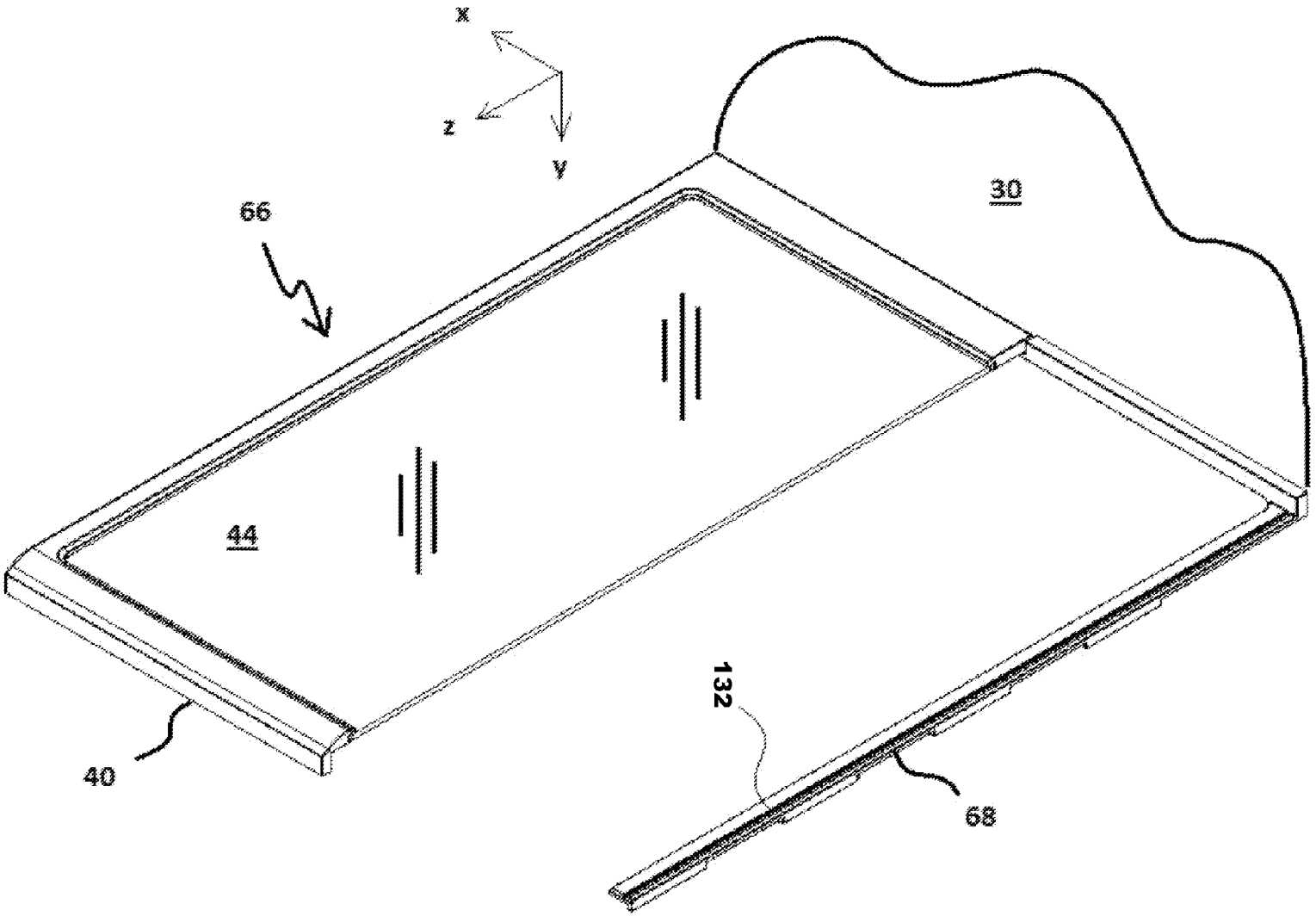
FIG. 6 shows a perspective view of a stationary member for the example shelf assembly.

The shelf assembly 38 can further include a stationary member 66, as shown in FIG. 6. The example stationary member 66 can have a substantially "U"-shaped geometry that includes the first shelf portion 40 and a latching member 68, that can be coupled by a rear member. Generally, the stationary member 66 is mounted over and onto the frame 54. Both the latching member 68 and the first planar support surface 44 of the first shelf portion 40 are arranged normal to the rear wall 30. The first shelf portion 40 is supported by side arm 57 and the latching member 68 is supported by the opposite side arm 56, as shown in FIGS. 4 & 5. The stationary member 66 can be removably or non-removably mounted to the frame 54 using fastening structure, such as mechanical fasteners (bolts, screws, clips, etc.) adhesive, or the like. The stationary member 66 may alternatively be integral with the frame 54. Generally, the stationary member 66 maintains the position of the first shelf portion 40.

The sliding mechanism for the shelf assembly 38 will now be discussed in further detail. The shelf assembly 38 can include a rear track 70 arranged substantially parallel to the rear wall 30 that is configured to guide one or more rear bearing members of the second shelf portion 42 as the second shelf portion 42 is slidably moved between the extended and retracted positions. FIGS. 4-5 show example embodiments wherein the rear track 70 comprises an example rear channel 72. The rear channel 72 can be coupled to or formed with the frame 54 and arranged substantially parallel to the rear wall 30. However, the rear channel 72 may be formed with the stationary member 66 or the rear wall 30. Meanwhile, the second shelf portion 42 includes rear bearing members 74, 75 shown in FIG. 7, that move together with the second shelf portion 42 and cooperate with the rear channel 72. In one example, the rear bearing members 74, 75 have relatively flat bottoms that rest on one or more surfaces within the rear channel 72. However, in other examples, the rear bearing members 74, 75 may take on other forms, such as wheels or blocks with rounded bottoms. Broadly speaking, the rear bearing members 74, 75 can be any portion of second shelf portion 42 that engages with the rear channel 72. Generally, the rear bearing members 74, 75 move together with the second shelf portion 42.

Figure 7:
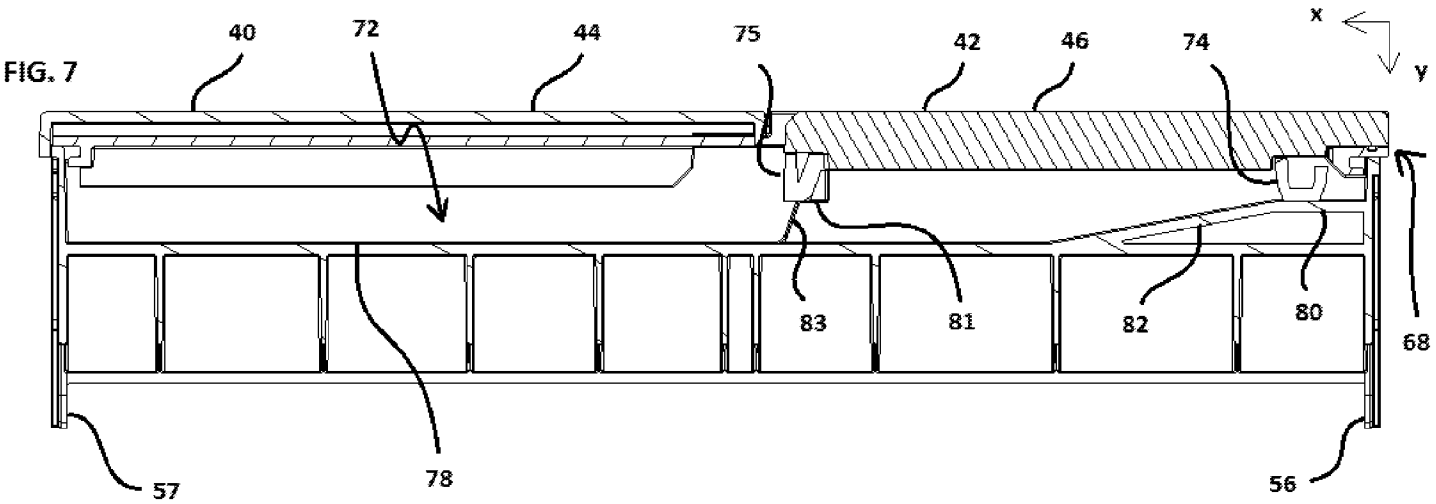
FIG. 7 shows a cross-sectional view of the example shelf assembly shown in FIG. 3, taken from line 7-7.

The rear channel 72 is configured to support and guide the rear bearing members 74, 75 as the second shelf portion 42 is slidably moved between the extended and retracted positions. The example channel 72 shown in FIG. 7 includes a lower surface 78, two raised surfaces 80 and 81, and two ramped surfaces 82 and 83 which respectively connect the lower surface 78 with raised surfaces 80 and 81. The rear channel 72 further includes a front wall 84 and two back walls 86 and 87 (shown in FIG. 5) that restrain the rear bearing members 74, 75 within the rear channel 72 and inhibit, such as prevent, the second shelf portion 42 from being pulled or pushed off the rear track 70. In the extended position, when the rear bearing members 74 and 75 are respectively resting on the raised surfaces 80 and 81, and the second shelf portion 42 is elevated such that the second planar support surface 46 is substantially coplanar with the first planar support surface 44, as shown in FIG. 7. Moreover, the second planar support surface 46 will be located generally between the first planar support surface 44 and side wall 36. Thus, the second shelf portion 42 is in the extended position when rear bearing members 74 and 75 are resting respectively on raised surfaces 80 and 81.

Figure 8:
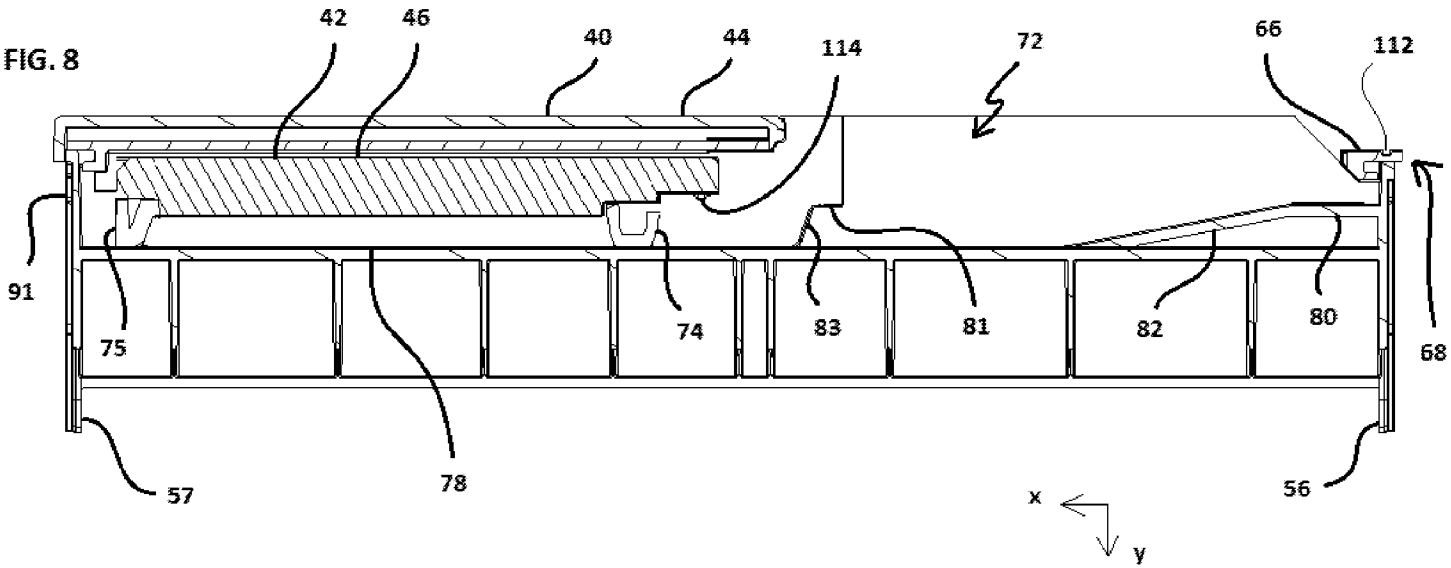
FIG. 8 is similar to FIG. 7, but shows with the second shelf portion in the retracted position.

Meanwhile, when the second shelf portion 42 is in the retracted position as illustrated in FIG. 8, rear bearing members 74 and 75 are resting on the lower surface 78 and rear bearing member 74 is located near end 91 of the rear channel 72. The second shelf portion 42 is lowered so that a majority of the second planar support surface 46 is arranged subjacent to the first planar support surface 44. Thus, the rear channel 72 is configured to support and guide the rear bearing members 74, 75 between lower surface 78 and raised surfaces 80 and 81 as the second shelf portion 42 is slidably moved laterally between the extended and retracted positions.

Preferably, the lower surface 78 and the raised surface 80 are horizontal. Thus, ramped surfaces 82, 83 facilitate raising and lowering of the second shelf portion 42. It is appreciated that the relative lengths and slopes of the lower, ramped, and raised surfaces can vary from the example shown in FIG. 7 without departing from the scope of the application. For example, the ramped surfaces 82, 83 can have different slopes. The raised surface 81 can be short and ramped surface 83 can be short and steep (e.g., larger slope) so that the left side (e.g., interior edge) of the second shelf portion 42 will lower quickly when moving the second shelf portion 42 from the position to retracted position. Otherwise, the second shelf portion 42 may interfere with the right side (e.g., adjacent interior edge) of the first shelf portion 40. For example, ramped surface 82 and raised surface 80 can be longer (e.g., smaller slope) as the right side of the second shelf assembly 38 may not interfere as quickly with the first shelf portion 40 if the right side is not immediately lowered in transition from the extended to retracted position. In addition or alternatively, the lower surface 78 and/or raised surfaces 80, 81 may be sloped rather than horizontal. Moreover, some embodiments may have just two long ramped surfaces that the two rear bearing members 74, 75 can respectively slide across. The surfaces within the rear channel 72 can take on a variety of configurations so that the second planar support surface 46 is elevated to be substantially coplanar with the first planar support surface 44 in the extended position, and lowered to be subjacent with the first planar support surface 44 in the retracted position.

Figure 9:
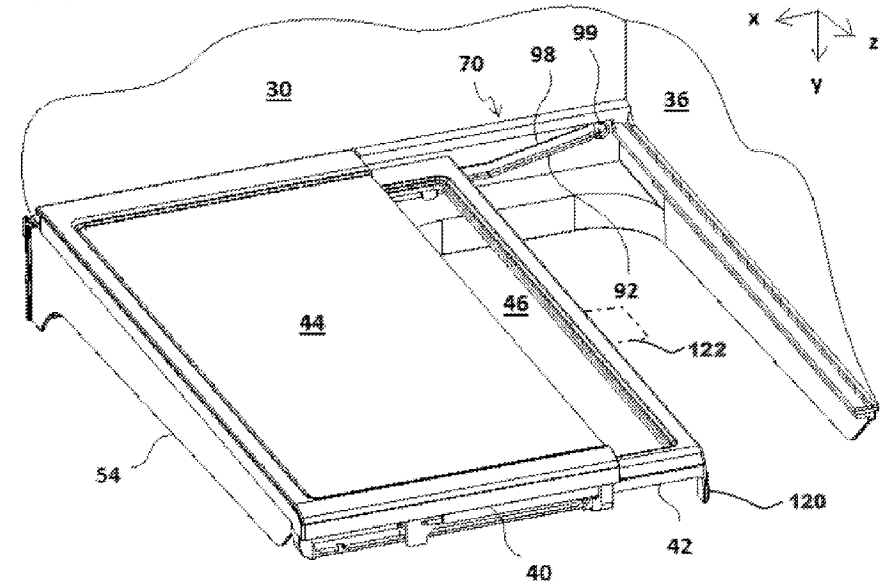
FIG. 9 shows a perspective view of another example shelf assembly which includes another example rear track.
Figure 10:
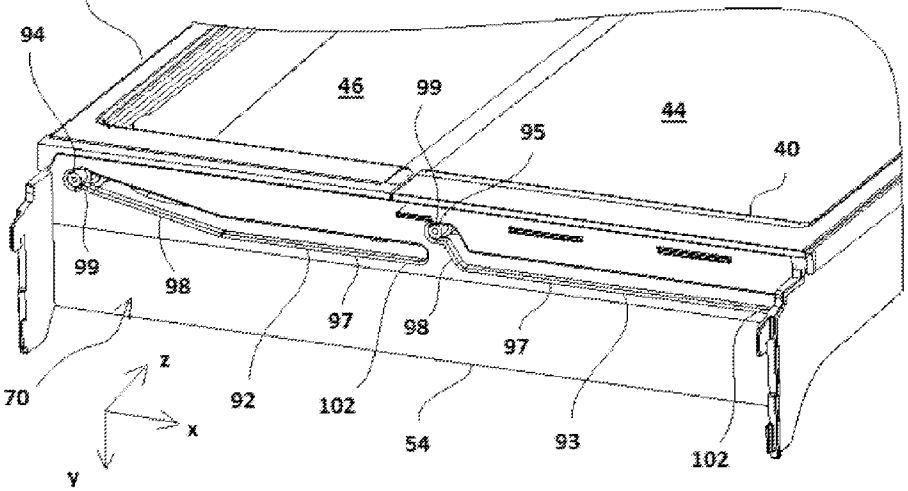
FIG. 10 shows a rear perspective view of the example shelf assembly of FIG. 9 showing the rear track.

Turning now to FIGS. 9 and 10, another example embodiment is illustrated wherein the rear track 70 comprises at least one rear elongated slot, such as a pair of elongated slots 92, 93. The rear elongated slots 92, 93 are arranged substantially parallel with the rear wall 30 and can be part of the stationary member 66 or could be part of or formed with the frame 54. Meanwhile, the second shelf portion 42 includes rear bearing members 94, 95 which respectively cooperate with rear elongated slots 92 and 93, as shown in FIG. 9. In the example embodiment, the rear bearing members 94, 95 comprise pegs which are screwed into the second shelf portion 42 so that each peg extends from the second shelf portion 42 and through one of the rear elongated slots 92, 93. The pegs rest on the bottom edges of the rear elongated slots which in turn provides support for the second shelf portion 42.

It should be appreciated that although the example embodiment shows the rear bearing members 94, 95 as pegs, the rear bearing members 94, 95 may take on other forms. For example, the rear bearing members 94, 95 may comprise wheels or shafts with heads. Moreover, rather than being screwed in, other mechanical fasteners could be used and/or the rear bearing members 94, 95 can be press fit into the second shelf portion 42, glued in using adhesive, or the rear bearing members can be made integral with the second shelf portion 42.

The rear elongated slots 92, 93 are configured to support and guide the rear bearing members 94, 95 as the second shelf portion 42 is slidably moved between the extended and retracted positions. For example, the rear elongated slots 92, 93 shown in FIG. 9 each include a lower section 97, a raised section 99, and a ramped section 98 that connects the lower section 97 with the raised section 99. When rear bearing members 94 and 95 are resting upon the raised sections 99, the second shelf portion 42 is elevated such that the second planar support surface 46 is substantially coplanar with the first planar support surface 44. Moreover, the second planar support surface 46 will be located generally between the first planar support surface 44 and side wall 36. As such, the second shelf portion 42 is in the extended position. Meanwhile, when the rear bearing members 94 and 95 are resting within the lower sections 97 and are located near ends 102 of rear elongated slots 92 and 93, the second shelf portion 42 is lowered so that a majority of the second planar support surface 46 is arranged subjacent to the first planar support surface 44. As such, the second shelf portion 42 is in the retracted position. Thus, the second shelf portion 42 can move between the extended and retracted positions as the rear bearing members 94 and 95 slide between the raised sections 99 and lower sections 97.

In the example embodiment illustrated in FIG. 9, the lower section 97 and the raised section 99 are substantially horizontal for each rear elongated slot. Additionally, for rear elongated slot 93, the raised section 99 is relatively short and the ramped section 98 is short and steep. These sections are shortened so that the left side of the second shelf portion 42 will lower quickly when moving the second shelf portion 42 from the extended to retracted position. Otherwise, the second shelf portion 42 may interfere with the right side of the first shelf portion 40. It should be appreciated though that the relative lengths and slopes of the lower 97, ramped 98, and raised 99 sections can vary for each rear elongated slot without departing from the scope of the application. For example, the ramped sections for both rear elongated slots 92, 93 can have various angles, such as even substantially vertical.

In some embodiments, the ramped section 98 and/or raised section 99 of rear elongated slot 92 can be longer as the right side of the second shelf portion 42 will not interfere as quickly with the first shelf portion 40 if the right side is not immediately lowered in transition from the position to retracted position. Moreover, in other embodiments, each rear elongated slot 92, 93 can simply comprise of a long ramped section. Still further, the two rear elongated slots 92, 93 may be connected to form one long rear elongated slot. The rear elongated slots 92, 93 can take on a variety of configurations so that the second planar support surface 46 is elevated to be substantially coplanar with the first planar support surface 44 in the extended position and lowered to be subjacent with the first planar support surface 44 in the retracted position.

Under the configuration shown in FIGS. 9-10, when the second shelf portion 42 is slidably moving from the retracted to the extended position, rear bearing member 94 is first elevated along ramped section 98 and then drops down into a recess or trough on the bottom edge of raised section 99, where rear bearing member 94 finally rests. When the rear bearing member 94 is located in the bottom of the raised section 99, the second planar support surface 46 will be properly aligned such that the second planar support surface 46 is coplanar with the first planar support surface 44 and located generally between the first planar support surface 44 and side wall 36. Due to this configuration of the rear elongated slot 92, when it is desired to slidably move second shelf portion 42 from the extended to the retracted position, the rear bearing member 94 first moves upward. Thus, this configuration inhibits, such as prevents, the second shelf portion 42, when extended, from inadvertently slidably moving back to retracted position without first applying an external force to first move the second shelf portion 42 upward. For example, a user can vertically lift the second shelf portion 42 so as to lift the rear bearing member(s) 94, 95 out of an associated trough. It is contemplated that either or both of the raised sections 99 can have a recess or trough for the associated rear bearing member 94, 95.

Figure 11:
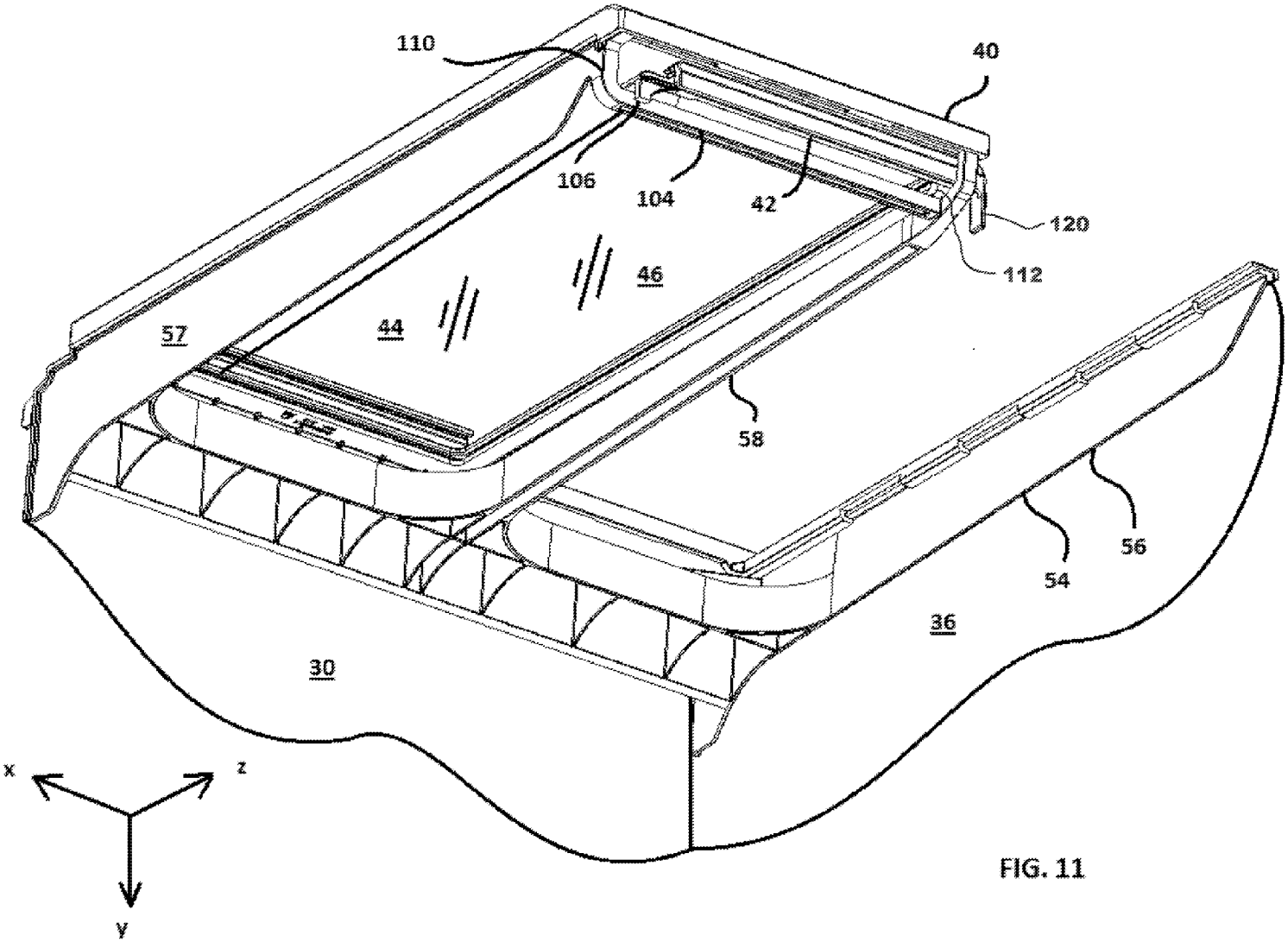
FIG. 11 shows a perspective view of an example shelf assembly which includes a front track and a front bearing member.

Turning now to FIG. 11, a front end of the second shelf portion 42 can be supported by another track that is used together with any of the rear track 70 or elongated slots 92, 93. For example, the shelf assembly 38 can further comprise a front track that is configured to guide a front bearing member of the second shelf portion 42 as the second shelf portion 42 is slidably moved between the extended and retracted positions. For example, FIGS. 5 and 11 shows an example front track that comprises a front guide member 104, located underneath the first shelf portion 40, that runs substantially parallel with the rear wall 30 and can be part of the frame 54, stationary member 66, or even first shelf portion 40. Meanwhile, the second shelf portion 42 includes a front bearing member 106 which cooperates and slides upon the front guide member 104, as shown in FIG. 11. The front bearing member 106 in the example embodiment is generally "U"-shaped and straddles the front guide member 104 as the second shelf portion 42 is slidably moved between the extended and retracted positions. When the front bearing member 106 is located near one end 110 of the front guide member 104, the second shelf portion 42 is lowered so that a majority of the second planar support surface 46 is arranged subjacent to the first planar support surface 44, as shown in FIG. 11. As such, the second shelf portion 42 is in the retracted position.

Meanwhile, when front bearing member 106 is resting on top of the front pedestal 108 at the other end of the front guide member 104, the second planar support surface 46 will be aligned such that the second planar support surface 46 is in the extended position and is substantially coplanar with the first planar support surface 44, and located generally between the first planar support surface 44 and side wall 36. Thus, the second shelf portion 42 can slidably move between the extended and retracted positions as the front bearing member 106 slides along the front guide member 104 between front pedestal 108 and end 110. The front guide member 104 can further include a ramped surface 112 leading to the pedestal 108, which can be similar or different from the ramped surfaces 82, 83. In one example, the ramped surface 112 leading to the pedestal 108 can be similar to the ramped surface 83 leading to the rear raised surface 81, such as having a similar slope, because these two ramped surfaces are positioned at similar locations on the tracks (e.g., ramped surface 83 is at the rear while the ramped surface 112 is at the front). Thus, the front and rear sections of the second shelf portion 42 can move similarly up and down when moved between the retracted and extended positions. Similarly, the pedestal 108 can have a similar height to the raised surface 81. Thus, the front and rear sections of the second shelf portion 42 can be provided at similar heights to that the support surface 46 is substantially flat.

Although the example of FIG. 11 shows a front track assembly that comprises a front guide member 104 and front bearing member 106 that straddles the guide member 104, the front track assembly can take on other various forms. For example, the front track assembly can comprise a channel and a bearing similar to what is provided for the rear track assembly shown in FIGS. 5, 7 & 8. Moreover the front track assembly may comprise a slot and a peg similar to what is provided for the rear track assembly shown in FIGS. 9 & 10. The front track assembly can take on a variety of configurations so that the second planar support surface 46 is elevated to be coplanar with the first planar support surface 44 in the extended position and lowered to be subjacent with the first planar support surface 44 in the retracted position.

In addition or alternatively, the shelf assembly 38 can further include a latching member 68 to inhibit the second shelf portion 42, when extended, from inadvertently sliding back towards the retracted position. As shown in FIGS. 6-8, the latching member 68 can be part of the stationary member 66 and is arranged normal to the rear wall 30. The latching member 68 can comprise a groove 132 that extends at least partially along, such as substantially the entire length of, the latching member 68. Meanwhile, the second shelf portion 42 can include a projection 114 (see FIG. 8) that is configured to mate with the groove 132 when the second shelf portion 42 is in the extended position, as shown in FIG. 7. Thus, in order to slidably move the second shelf portion 42 from the extended to retracted position, the projection 114 is first moved upward by a user to remove the projection 114 from the groove 132. This configuration inhibits the second shelf portion 42, when extended, from inadvertently slidably moving back to the retracted position by utilizing an external force to first move the second shelf portion 42 upward before the second shelf portion 42 can move laterally (e.g., between the pair of opposed side walls 36, 37).

In addition or alternatively, the second shelf portion 42 can further include handles or other operative structure to enable a user to move the second shelf portion 42 between the retracted and extended positions. Various types of handles can be used, having various geometries and/or locations. In one example, shown in FIGS. 4 and 11, a handle 120 can be provided at one end of the second shelf portion 42. The handle 120 can be grasped by a user to slidably move the second shelf portion 42 laterally between the retracted and extended positions, and can also be used to lift the second shelf portion 42 vertically to dislodge the projection 114 from the groove 132. The handle 120 can be coupled to or even formed with the second shelf portion 42, and can be a stationary handle. In another example, also shown in FIG. 4, a movable handle 122 can be provided to the second shelf portion 42. The movable handle 122 can operate similarly to the handle 120 discussed above. However, the movable handle 122 can be movably coupled to the second shelf portion 42 so as to be positioned outwards in an operative condition, as shown in FIG. 4, only when the second shelf portion 42 is being moved. The movable handle 122 can be movably coupled to the second shelf portion 42 in various manners, such as rotatably/pivotably coupled or slidably coupled. After the second shelf portion 42 has moved to either of the extended or retracted positions, the movable handle 122 can be moved to a non-operative position (e.g., slid inwards or folded down) so that it is out of the way.

It should be apparent that the foregoing relates only to certain embodiments of the present application and that numerous changes and modifications may be made herein by one of ordinary skill in the art without departing from the general spirit and scope of the invention as defined by the following claims and equivalents thereof.

What is claimed is:

1. A shelf assembly for a refrigerator comprising a food compartment and a door configured to provide access to the food compartment, the food compartment comprising a rear wall and a pair of opposed side walls extending normal from the rear wall, the shelf assembly comprising:

a first shelf portion comprising a first planar support surface that is arranged normal to the rear wall and the pair of opposed side walls; a second shelf portion comprising a second planar support surface, the second shelf portion being slidably moveable relative to the first shelf portion between an extended position and a retracted position;

a rear track having a first ramp surface and a second ramp surface, the rear track configured to support and guide the second shelf portion as the second shelf portion is slidably moved between the extended and retracted positions, wherein at the extended position, the second shelf portion is arranged relative to the first shelf portion such that the second planar support surface is substantially coplanar with the first planar support surface and the second planar support surface is located generally between the first planar support surface and one of the side walls, and wherein at the retracted position, a majority of the second planar support surface is arranged subjacent to the first planar support surface, and a frame configured to support the first and the second shelf portions, wherein the frame includes two opposed side arms and a middle support arm that are arranged in parallel and extend from the rear track.

2. The shelf assembly according to claim 1, wherein the second shelf portion comprises a rear bearing member.

3. The shelf assembly according to claim 2, wherein the rear track is arranged substantially parallel to the rear wall and configured to guide the rear bearing member as the second shelf portion is slidably moved between the extended and retracted positions.

4. The shelf assembly according to claim 3, wherein the rear track comprises an elongated slot.

5. The shelf assembly according to claim 3, wherein the rear track comprises a channel.

6. The shelf assembly according to claim 3, wherein the rear track is configured such that, when the second shelf portion is slidably moved from the extended position to the retracted position, the rear bearing member first moves upward.

7. The shelf assembly according to claim 1, wherein the second shelf portion comprises a front bearing member and the shelf assembly further comprises a front track that is configured to guide the front bearing member as the second shelf portion is slidably moved between the extended and retracted positions.

8. The shelf assembly according to claim 7, wherein the front track is substantially the same width as the first shelf portion.

9. The shelf assembly according to claim 1, further comprising a latching member that comprises a groove, and wherein the second shelf comprises a projection configured to mate with the groove when the second shelf portion is in the extended position.

10. The shelf assembly according to claim 1, wherein one side arm is configured to support the second shelf portion in its extended position.

11. The shelf assembly according to claim 10, wherein the latching member extends substantially the entire length of the side arm configured to support the second shelf portion in its extended position.

12. A shelf assembly for a refrigerator comprising a food compartment and a door configured to provide access to the food compartment, the food compartment comprising a rear wall and a pair of opposed side walls extending normal from the rear wall, the shelf assembly comprising:

a first shelf portion comprising a first planar support surface, the first planar support surface arranged normal to the rear wall and the pair of opposed side walls;

a second shelf portion comprising a second planar support surface and first and second rear bearing members located at opposite ends of the second shelf portion, the second shelf portion being slidably moveable relative to the first shelf portion between an extended position and a retracted position; and a rear channel comprising a first track laterally offset from a second track, the first track comprising a first ramp surface for engagement with the first rear bearing member and the second track comprising a second ramp surface for engagement with the second rear bearing member, the rear channel arranged substantially parallel to the rear wall and configured to separately guide the first and second rear bearing members as the second shelf portion is slidably moved between the extended and retracted positions, wherein the rear channel further comprises a first back wall and a second back wall to thereby define the first track and the second track, and the first back wall is laterally offset from the second back wall so that the first track is laterally offset from the second track, wherein at the extended position, the second shelf portion is arranged relative to the first shelf portion such that the second planar support surface is substantially coplanar with the first planar support surface and the second planar support surface is located generally between the first planar support surface and one of the side walls, and wherein at the retracted position, a majority of the second planar support surface is arranged subjacent to the first planar support surface.

13. The shelf assembly according to claim 12, wherein the rear channel comprises a lower surface and a pair of raised surfaces, and wherein each of the first and second ramped surfaces connects the lower surface with each of the raised surfaces.

14. The shelf assembly according to claim 13, wherein the rear channel is configured such that when the second shelf portion is at the extended position, the first and second rear bearing members are resting on the raised surfaces.

15. The shelf assembly according to claim 13, wherein the rear channel is configured such that when the second shelf portion is at the retracted position, the first and second rear bearing members are resting on the lower surface.

16. The shelf assembly according to claim 12, wherein each of the first and second ramped surfaces have a different slope.

17. The shelf assembly according to claim 16, wherein the first and second rear bearing members extend normally from a rear surface of the second shelf portion and are located on opposite ends of the rear surface, wherein the first and second rear bearing members are each configured to interact with one of the pair of raised surfaces and the pair of ramped surfaces.

* * * * *